US012667198B1

(12) United States Patent
Yang

(10) Patent No.: US 12,667,198 B1
(45) Date of Patent: Jun. 30, 2026

(54) CONVENIENT BED STRUCTURE WITH IMPROVED SUPPORT ASSEMBLIES AND A SUPPORTING STRUCTURE

(71) Applicant: Formosa Saint Jose Corporation, Taipei (TW)

(72) Inventor: Ming-Shun Yang, Taipei (TW)

(73) Assignee: Formosa Saint Jose Corporation, Taipei (TW)

( * ) Notice: Subject to any disclaimer, the term of this patent is extended or adjusted under 35 U.S.C. 154(b) by 0 days.

(21) Appl. No.: 19/391,727

(22) Filed: Nov. 17, 2025

(51) Int. Cl.
*A47C 17/64* (2006.01)
*A47C 17/76* (2006.01)

(52) U.S. Cl.
CPC ..... *A47C 17/645* (2013.01); *A47C 17/64* (2013.01); *A47C 17/76* (2013.01)

(58) Field of Classification Search
CPC ..... A47C 17/645; A47C 17/64; A47C 17/76; A47C 17/86
USPC ..... 5/110–112, 114
See application file for complete search history.

(56) References Cited

U.S. PATENT DOCUMENTS 1,170,229 A * 2/1916 Ferguson ..... A47C 19/126 5/117
1,360,201 A * 11/1920 Dyett ..... A47C 17/72 5/117
6,553,586 B1 * 4/2003 Lin ..... A47C 17/64 5/117
7,856,683 B2 * 12/2010 Zheng ..... A47C 17/72 5/116
8,656,531 B1 * 2/2014 Holmes ..... A47C 5/06 5/112
8,806,675 B2 * 8/2014 Lah ..... A47C 19/00 5/116
9,526,347 B2 12/2016 Boyd
9,687,400 B2 6/2017 Bly et al.
10,820,709 B2 * 11/2020 Yang ..... A47C 17/70
10,888,172 B2 * 1/2021 Xia ..... A47C 27/081
11,076,702 B2 * 8/2021 Zhang ..... A47C 17/645
11,229,563 B2 1/2022 Lacasse et al.
11,576,496 B2 * 2/2023 Zhu ..... A47C 17/66
11,918,123 B2 * 3/2024 Zhu ..... A47C 17/64
D1,053,642 S * 12/2024 Wang ..... D6/709.2
(Continued)

*Primary Examiner* — Robert G Santos
(74) *Attorney, Agent, or Firm* — Ying-Ting Chen

(57) ABSTRACT

The present invention discloses a convenient bed structure with an improved support assembly and a supporting structure. The convenient bed structure includes: a bed fabric; two straight bars; and plural support assemblies. The supporting structure includes a U-shaped branch, a pair of leg brackets, and two C-shaped opening sliding sleeves. With the implementation of the present invention, the convenient bed structure with the improved support assembly has the following special effects: it can be easily operated and assembled; it has a highly safe combination structure; it will not loosen and cause tipping, thus avoiding the danger of use. It can be immediately applied to various different application needs including home use, hospital or outdoor places, achieving the purpose of multi-functional and multi-occasion application. Under the important premise of ensuring that it does not tip over during use, it effectively increases the user's willingness to use and the application occasions where it is suitable for use.

12 Claims, 9 Drawing Sheets

(56) References Cited

U.S. PATENT DOCUMENTS

| | | | | |
|---|---|---|---|---|
| 2009/0178195 | A1* | 7/2009 | Zheng | A47C 19/126 5/111 |
| 2014/0115780 | A1* | 5/2014 | Lah | A47C 19/12 5/111 |
| 2018/0014654 | A1* | 1/2018 | Yang | A47C 17/68 |
| 2018/0070735 | A1* | 3/2018 | Xia | A47C 19/122 |
| 2021/0127844 | A1* | 5/2021 | Zhang | A47C 17/74 |
| 2022/0225782 | A1* | 7/2022 | Zhu | A47C 17/66 |
| 2022/0248869 | A1* | 8/2022 | Zhu | A47C 17/64 |

* cited by examiner

CONVENIENT BED STRUCTURE WITH IMPROVED SUPPORT ASSEMBLIES AND A SUPPORTING STRUCTURE

BACKGROUND OF THE INVENTION

1. Technical Field

The present invention relates to a convenient bed structure and a supporting structure, and in particular to a convenient bed structure with improved support assemblies; and a supporting structure that will not loosen.

2. Description of Related Art

A convenient bed, also known as a cot, a camp bed or a simple bed, is a convenient item used in many situations. There are many types of convenient beds, but their structure generally consists of a tough and durable bed fabric with two straight bars (or cross bars) and several supporting legs.

While the left and right arms connecting the bed's support legs to the bed's surface also utilize a C-shaped structure that directly engages with the two straight bars on the bed's surface in most existing conventional convenient beds known, this presents a fatal flaw: during use, the upward-facing C-shaped structure and the straight bars can easily come detached due to the horizontal force exerted by the weight of a reclining body, creating an extremely dangerous situation. Furthermore, to maintain the bed's tightness, the arms must be squeezed together, making the operation extremely inconvenient and particularly problematic for female users.

Even if there are slight improvements, such as the structure disclosed in U.S. Patent No. U.S. Pat. No. 8,806,675B2, although the support leg of the disclosed structure is connected to the bed surface with a C-shaped structure on one side of the side arm, the other side uses a "clamping handle" structure to buckle with the straight rod of the bed surface. In this way, the same shortcomings as the aforementioned conventional structure still exist: after the C-shaped structure on one side is engaged with the straight rod, the clamping handle on the other side needs to be tightened inward with force, which is also not easy to operate especially for the female or children. On the other hand, because the clamping handle is also a C-shaped structure, the junction between the C-shaped structure and the spring protrusion will expand outward due to the force of carrying heavy objects such as the human body, and eventually become detached. The structure disclosed in U.S. Patent No. U.S. Pat. No. 8,806,675B2 still has the same risk of tipping over when actually used.

Accordingly, an improved device is invented and is easy to assemble and has a highly secure combination structure; with only a light push on the side C-shaped opening sliding sleeve can achieve a tightening effect through the center length difference of the lateral C-shaped openings on both sides will not loosen and cause tipping after the C-shaped opening sliding sleeve extends outward; thus avoiding the danger of use. It can be immediately adapted to various application needs including homes, hospitals, or outdoor places, achieving the purpose of multi-functional and multi-occasion application. The invention and manufacture of a convenient bed structure with improved support assemblies and a supporting structure effectively increase users' willingness to use and the application occasions where it is suitable for use, while ensuring that it will not tip over during use.

SUMMARY OF THE INVENTION

The present invention discloses a convenient bed structure with improved support assemblies and a supporting structure. The convenient bed structure with improved support assemblies includes: a bed fabric; two straight bars; and a plurality of support assemblies, arranged in the same direction between the two straight bars to effectively support the entire load of the convenient bed structure. The supporting structure includes a U-shaped branch, a pair of leg brackets connected to the two U-shaped bends of the U-shaped branch, and two C-shaped opening sliding sleeves connected to the side arms on both sides of the U-shaped branch. Each C-shaped opening sliding sleeve can slide on the side arm of the U-shaped branch or be fixed to the side arm of the U-shaped branch by a protruding tenon provided on the C-shaped opening sliding sleeve. The special effects of the present invention include: easy assembly and operation; a highly secure overall design; and a slight push of the C-shaped opening sliding sleeves on both sides of each support assembly to achieve a secure tightening by extending the sleeves outwards to avoid loosening and tipping, thus avoiding the danger of use.

The present invention provides a convenient bed structure with improved support assemblies, which includes: a bed fabric, which is long and has two opposite long sides, and the pair of long sides are respectively formed with a plurality of annular wrapping structures; two straight rods, one straight rod passes through each and every annular wrapping structures of one long side, for supporting the load carried by the bed fabric; and a plurality of support assemblies for supporting the entire load of the convenient bed structure, which are arranged in the same direction between the two bed straight rods, and each support assembly is respectively buckled and fastened to the two straight rods by C-shaped opening sliding sleeves arranged at both ends; any of the support assemblies includes a U-shaped branch, a pair of leg brackets connected to the two bend portions of the U-shaped branch, and two C-shaped opening sliding sleeves connected to the side arms arranged on both sides of the U-shaped branch, wherein any C-shaped opening sliding sleeve can be slid on the side arm of the U-shaped branch or fixed to the side arm of the U-shaped branch by a protruding tenon arranged on the C-shaped opening sliding sleeve.

The present invention further provides a supporting structure that includes: a U-shaped branch; a pair of leg brackets connected to the two bend portions of the U-shaped branch; and two C-shaped opening sliding sleeves connected to the two side arms of the U-shaped branch, wherein each C-shaped opening sliding sleeve is a side-opening sliding sleeve; any one of the C-shaped opening sliding sleeves can slide on the side arm of the U-shaped branch or be fixed to the side arm of the U-shaped branch by a protruding tenon provided on the C-shaped opening sliding sleeve.

Implementation of the present invention at least involves the following inventive steps:

1. Easy to operate and assemble.
2. Highly secure bonding structure.
3. It will not loosen and fall over, thus avoiding the danger of use.
4. Can be immediately used in places such as home, hospital or field, or other occasions where needed.

The features and advantages of the present invention are detailed hereinafter with reference to the preferred embodiments. The detailed description is intended to enable a person skilled in the art to gain insight into the technical contents disclosed herein and implement the present invention accordingly. In particular, a person skilled in the art can easily understand the objects and advantages of the present invention by referring to the disclosure of the specification, the claims, and the accompanying drawings.

BRIEF DESCRIPTION OF THE SEVERAL VIEWS OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE EMBODIMENTS OF THE INVENTION

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

Figure 1:
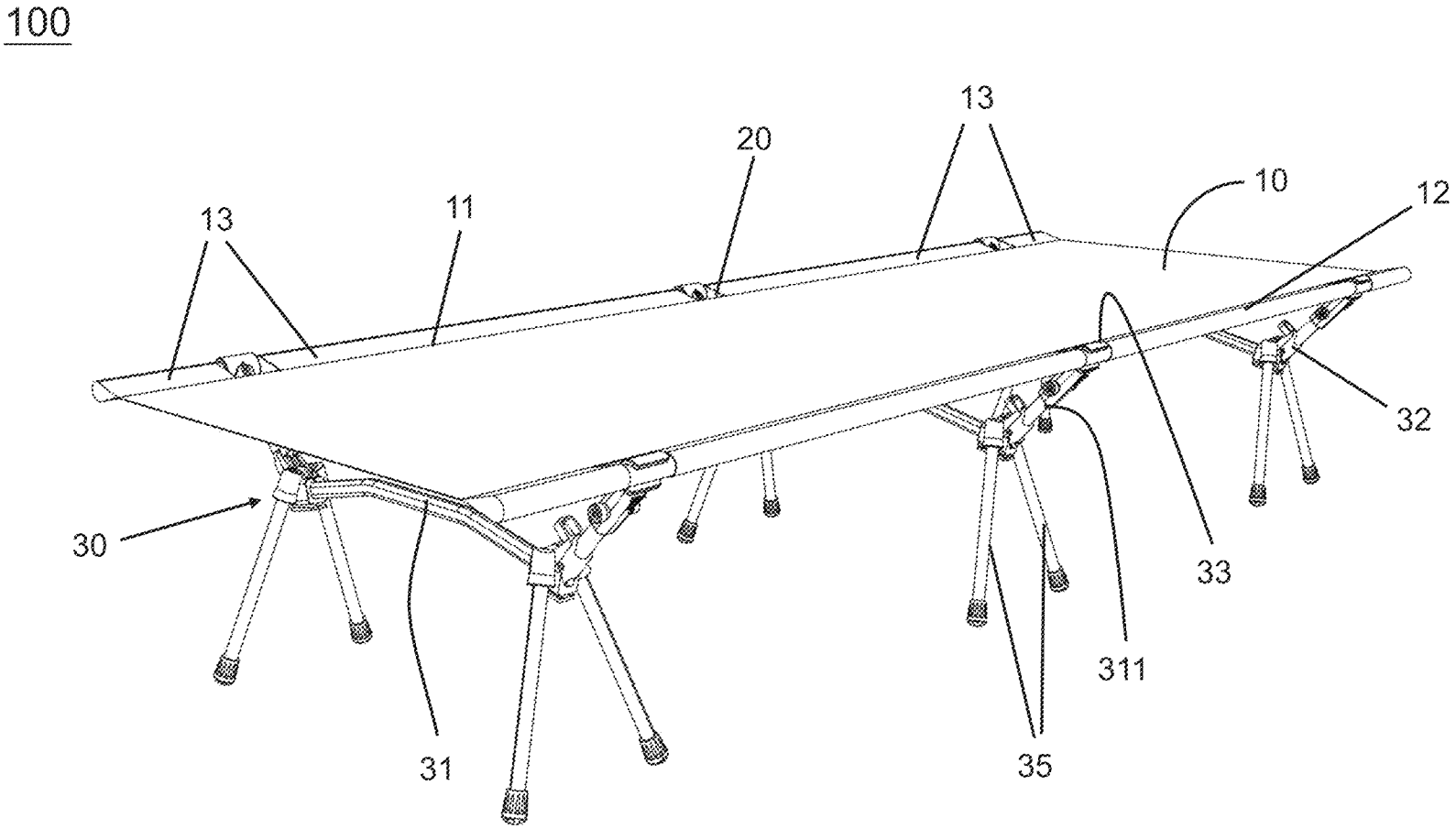
FIG. 1 is a perspective 3 dimensional view of a convenient bed structure with improved support assemblies according to an embodiment of the present invention.

First, please refer to FIG. 1, which illustrates an embodiment of a convenient bed structure 100 with improved support assemblies 30. The convenient bed structure 100 with improved support assemblies 30, as shown in FIG. 1, can be conveniently and safely used in various applications, such as home use, medical treatment, and leisure. The convenient bed structure 100 with improved support components includes a bed fabric 10; two straight bars 20; and a plurality of support assemblies 30.

As shown in FIG. 1, the bed fabric 10 of the convenient bed structure 100 with improved support assemblies 30 is made of a flexible material, preferably one that is breathable and comfortable to the touch. The bed fabric 10 can be in the form of a long strip large enough to accommodate at least one person. The bed fabric 10 has opposing long side 11 and long side 12, each of which is formed with a plurality of annular wrapping structures 13. The seating surface formed by the bed fabric 10 can typically be formed in a rectangular shape for a wider range of applications.

As shown in FIG. 1, the two straight bars 20 of the convenient bed structure 100 with improved support assemblies 30 are lightweight, strong, and preferably resistant to bending, deformation, or breakage. An alloy is a suitable material. One straight bar 20 fits through each annular wrapping structure 13 of the long side 11, while the other straight bar 20 fits through each annular wrapping structure 13 of the long side 12. The two straight bars 20 are used to jointly support and confine the bed fabric 10 and the load of the passenger.

Figure 2:
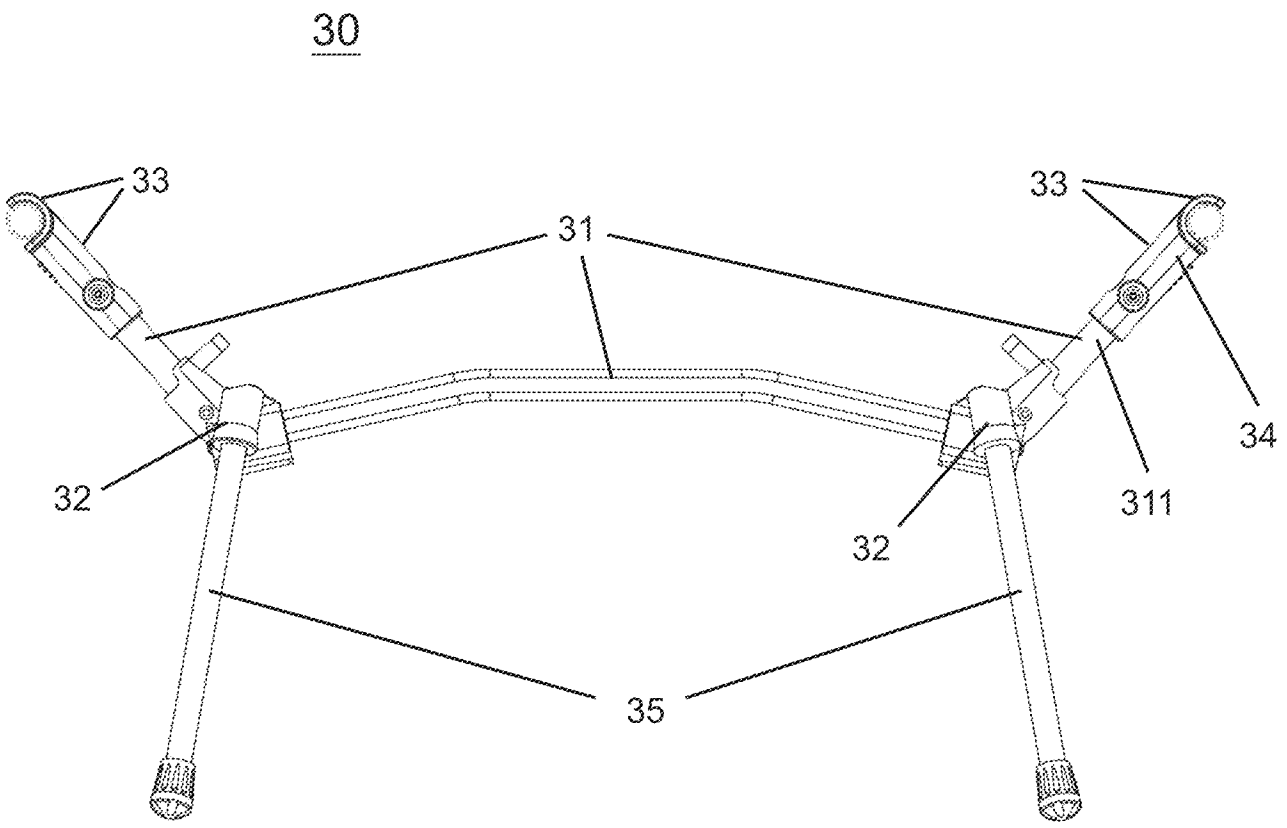
FIG. 2 is a perspective view of is a schematic diagram of a support assembly of a convenient bed structure according to an embodiment of the present invention.

Please refer to FIG. 1 and FIG. 2, the support assemblies 30 of the convenient bed structure 100 with improved support assemblies 30 are used to support the convenient bed structure 100 and the entire load. Each support assembly 30 is arranged in the same direction between two straight bars 20. Each support assembly 30 is respectively secured to and clamped to the two straight bars 20 using C-shaped opening sliding sleeves 33 provided at each end.

As shown in FIG. 1 to FIG. 4, any support assembly 30 includes a U-shaped branch 31, a pair of leg brackets 32 connected to the two U-shaped bends of the U-shaped branch 31, and two C-shaped opening sliding sleeves 33 connected to the ends of the side arms 311 on both sides of the U-shaped branch 31.

Next, please refer to FIGS. 1, 2, 3 and 6, any C-shaped opening sliding sleeve 33 of each support assembly 30 in the convenient bed structure 100 with an improved support assemblies 30 can slide on the side arm 311 of the U-shaped branch 31, or be fixed to the side arm 311 of the U-shaped branch 31 by a protruding tenon 34 set on the C-shaped opening sliding sleeve 33.

As shown in FIG. 1 to FIG. 6, any of the the C-shaped opening sliding sleeve 33 is a lateral C-shaped opening sleeve 33. The lateral C-shaped opening sliding sleeve 33 mentioned here refers to a sleeve in which the C-shaped opening at the end of the sleeve is in a direction perpendicular to the sleeve or has an angle with the sleeve.

Furthermore, during use, when any C-shaped opening sliding sleeve 33 is engaged and securely clamped to a straight bar 20, the opening of the C-shaped opening sliding sleeve 33 faces outward. In other words, when the C-shaped opening sliding sleeve 33 is engaged and securely clamped to a straight bar 20, the C-shaped opening faces the outside of the convenient bed structure 100. This provides an additional structural support to prevent loosening.

Next, please refer to the convenient bed structure 100 with improved support assemblies 30 as shown in FIGS. 1 to 6. When in use, after the C-shaped opening sliding sleeves 33 at both ends of each support assembly 30 are respectively engaged with the two straight bars 20, each C-shaped opening sliding sleeve 33 can be slid toward the straight bar 20, as shown in the direction of the arrow of the sliding direction A in FIG. 3, and is fixed to the side arm 311 of the U-shaped branch 31 with a protruding tenon 34, so that a center length difference is generated between the C-shaped opening sliding sleeves 33 on both sides of the support assembly 30. The generated center length difference generates an outward tightening stress, which firmly tightens the straight bars 20 on both sides. In addition, the C-shaped opening sliding sleeve 33 is fixed to the support arm 311 of the U-shaped branch 31 with the protruding tenon 34 without sliding, and the support assembly 30 will not move or loosen, ensuring the safe use of the convenient bed structure 100.

Referring again to FIGS. 1 through 3, the C-shaped opening sliding sleeve 33 is secured to the side arm 311 of the U-shaped branch 31 with a protruding tenon 34, preventing it from sliding. Each side arm 311 of the U-shaped branch 31 is provided with a retaining groove 312 corresponding to the protruding tenon 34 of the C-shaped opening sliding sleeve 33. When the C-shaped opening sliding sleeve 33 slides into its corresponding position, the protruding tenon 34 enters and latches into the retaining groove 312, preventing the tightened C-shaped opening sliding sleeve 33 from moving or rotating.

Figure 3:
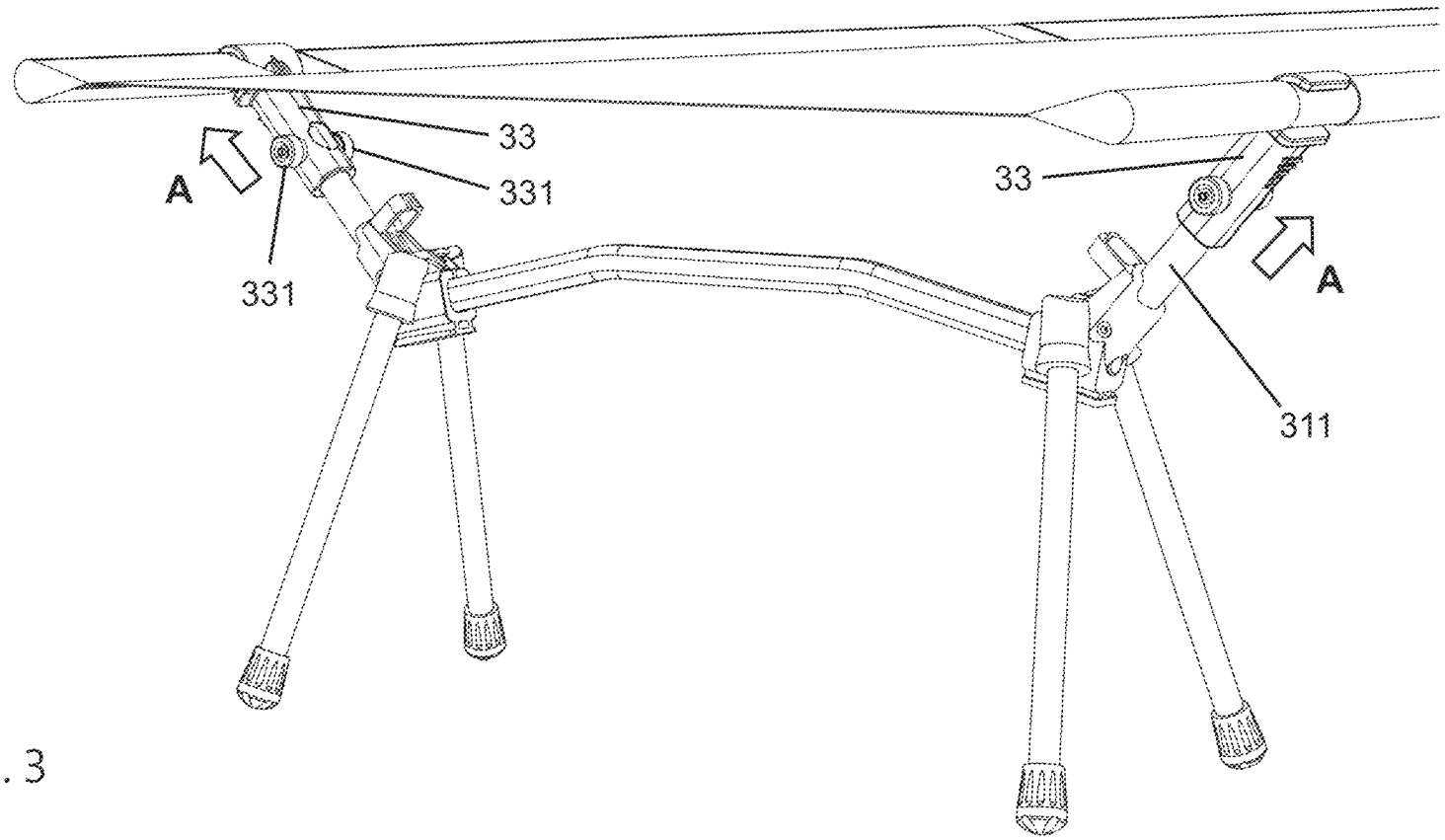
FIG. 3 is a perspective 3 dimensional view of a support assembly according to an embodiment of the present invention.
Figure 4:
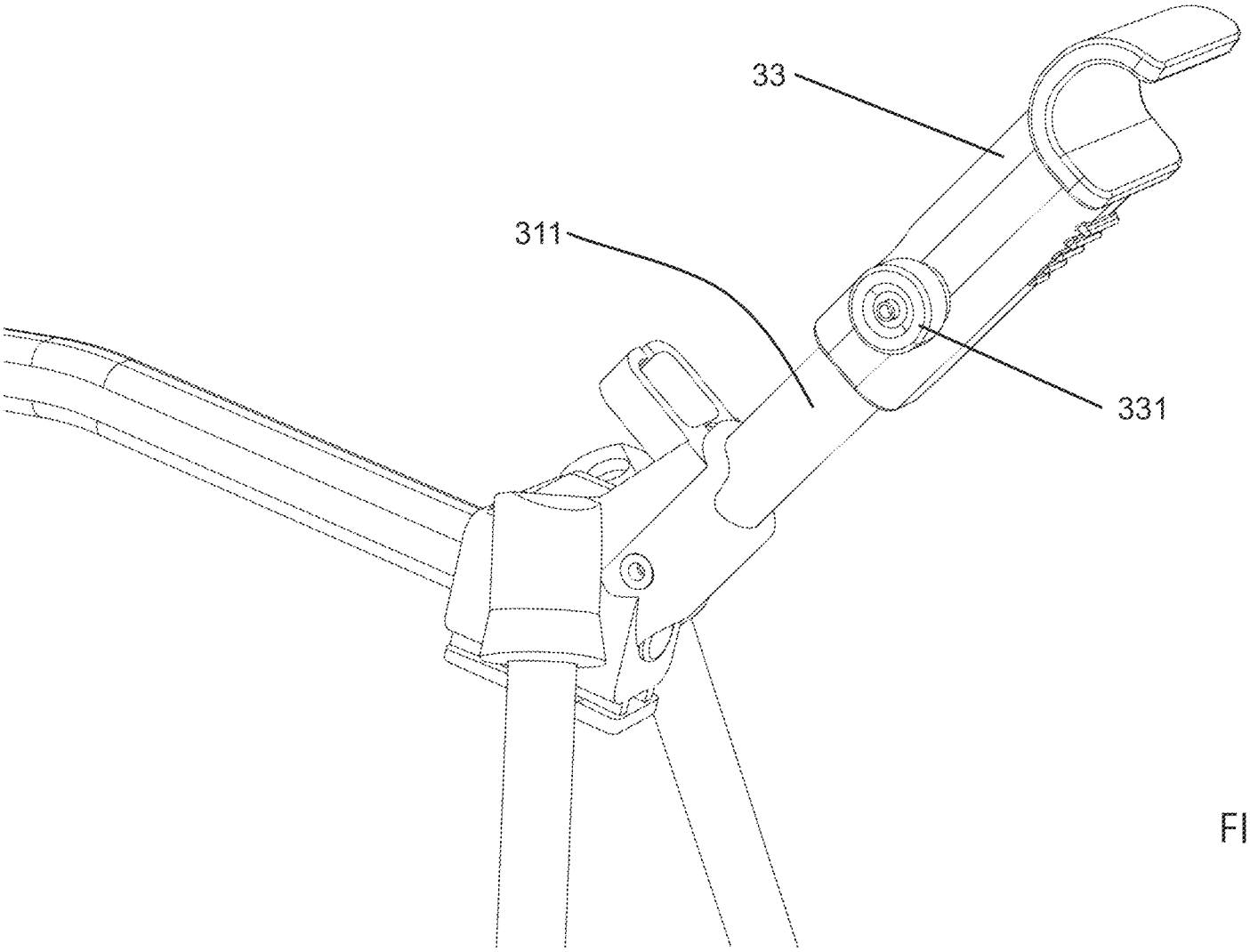
FIG. 4 is a perspective view of a C-shaped opening sleeve mounted on a side arm of a support assembly according to an embodiment of the present invention.

After the convenient bed structure 100 is used, to loosen the tight clamping of the C-shaped opening sliding sleeve 33 on the straight bar 20, it is only necessary to press down the release button 331 provided on the C-shaped opening sliding sleeve 33 corresponding to the position of the retaining groove 312 of the side arm 311, and the protruding tenon 34 can be pushed out of the retaining groove 312, and then the C-shaped opening sliding sleeve 33 can be slid away from the straight bar 20 in the opposite direction of the arrow direction of the sliding direction A as shown in FIG. 3.

Figure 5:
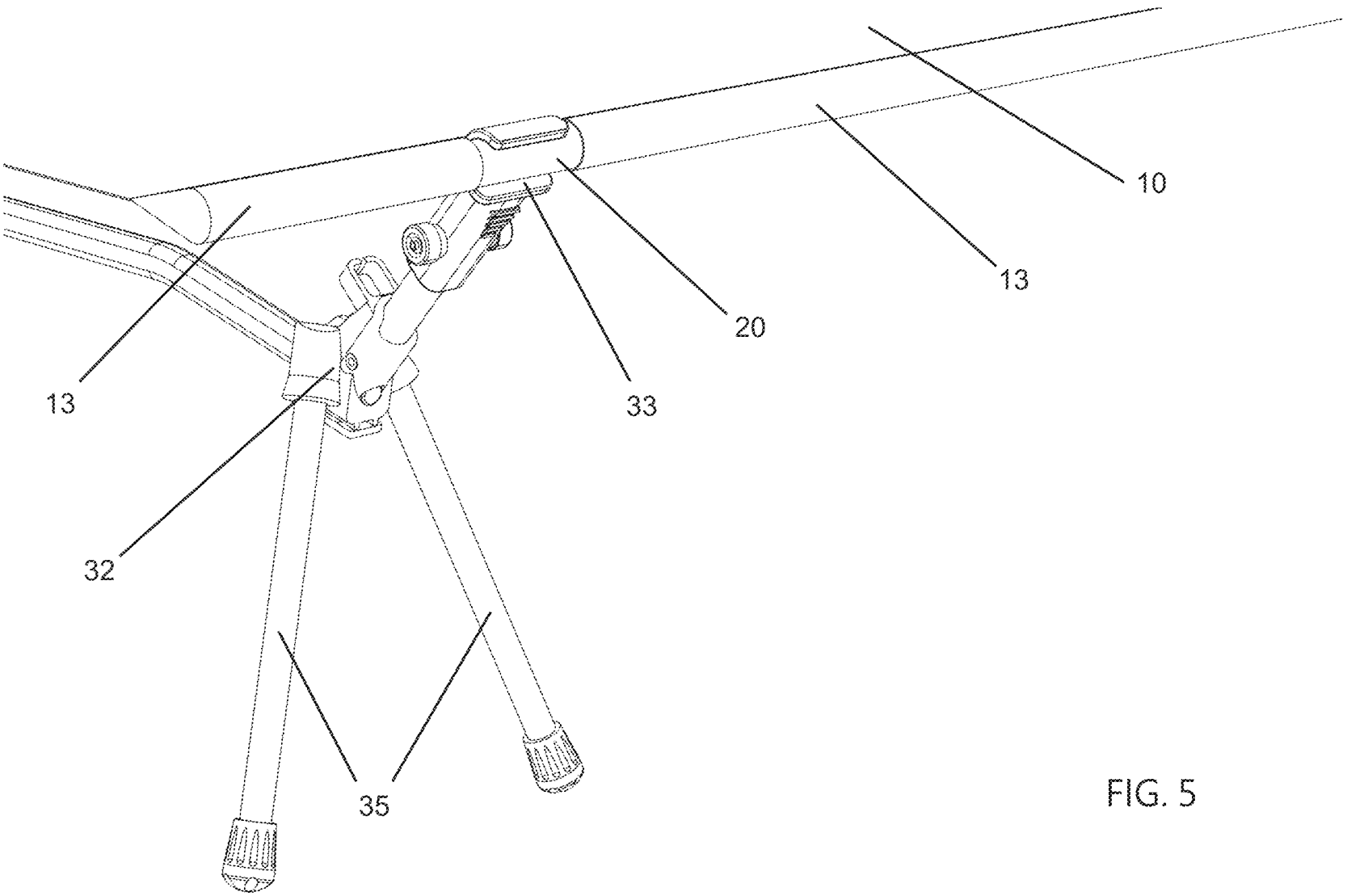
FIG. 5 is a perspective view of a support assembly mounted on a straight bar according to an embodiment of the present invention.
Figure 6:
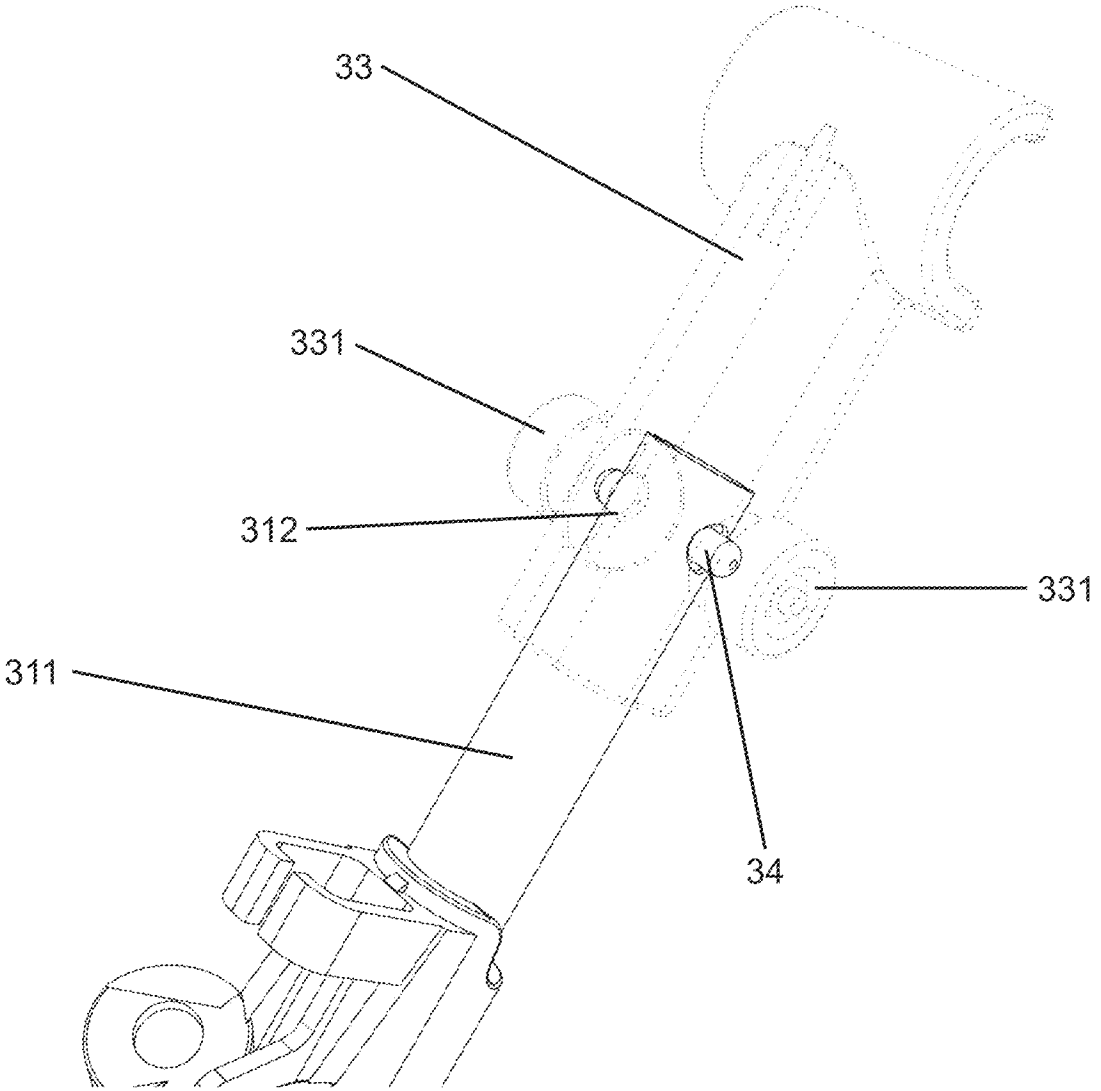
FIG. 6 is a perspective view of a C-shaped opening sliding sleeve, a protruding tenon, a side arm, and a retaining groove according to an embodiment of the present invention.

As shown in FIGS. 1, 3, and 5, a pair of leg brackets 32 are connected and disposed at two U-shaped bends of a U-shaped branch 31. Each leg bracket 32 has at least two legs 35. The leg brackets 32 of this embodiment have two legs 35, which is a more convenient choice both for stability during use and convenience during storage.

Figure 7:
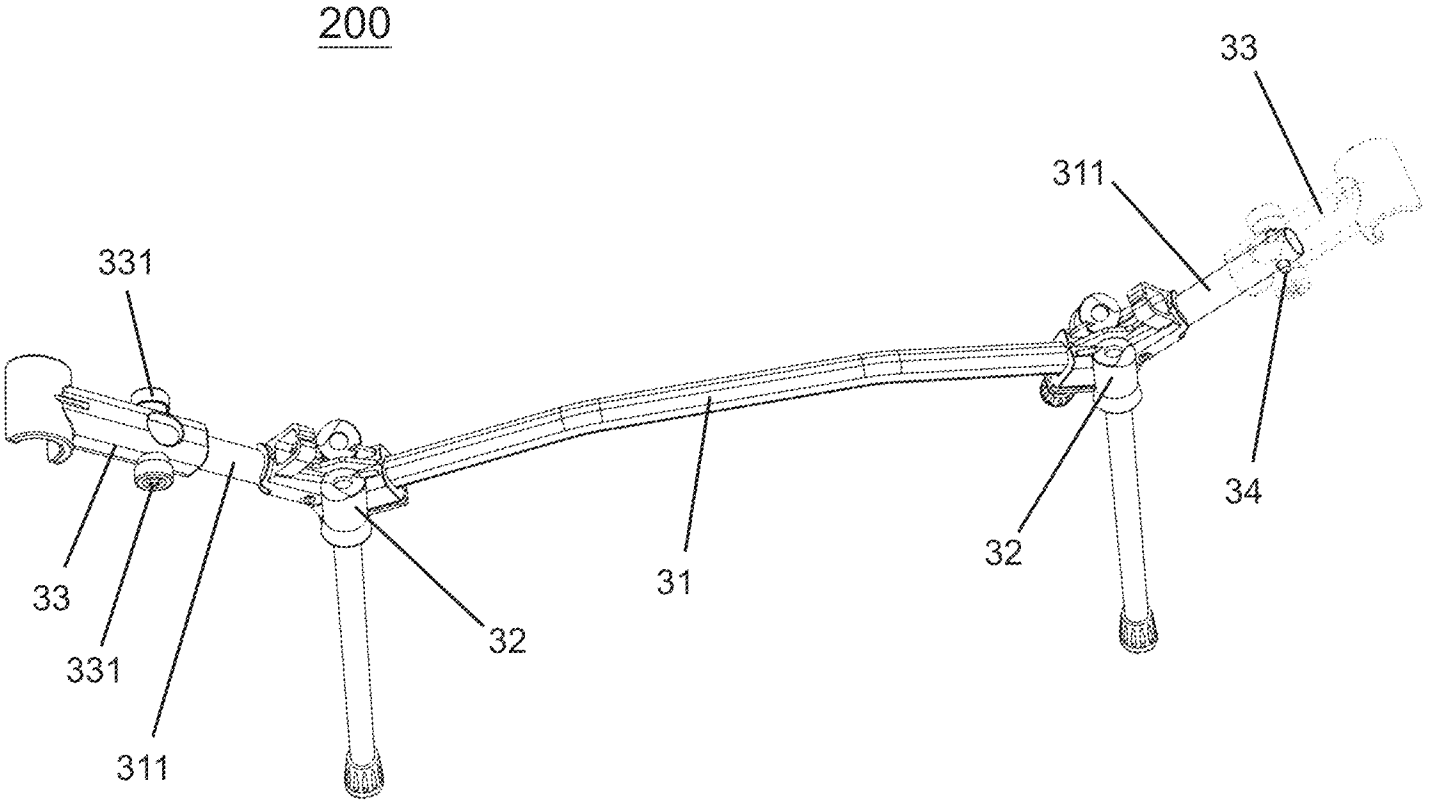
FIG. 7 is a perspective view of a supporting structure according to an embodiment of the present invention.

Next, please refer to FIG. 7, which shows a supporting structure 200 according to an embodiment of the present invention. The supporting structure 200 includes a U-shaped branch 31, a pair of leg brackets 32, and two C-shaped opening sliding sleeves 33. The material of supporting structure 200 is preferably lightweight, strong, and resistant to bending, deformation, or breakage. Alloy is also a suitable material.

Figure 9:
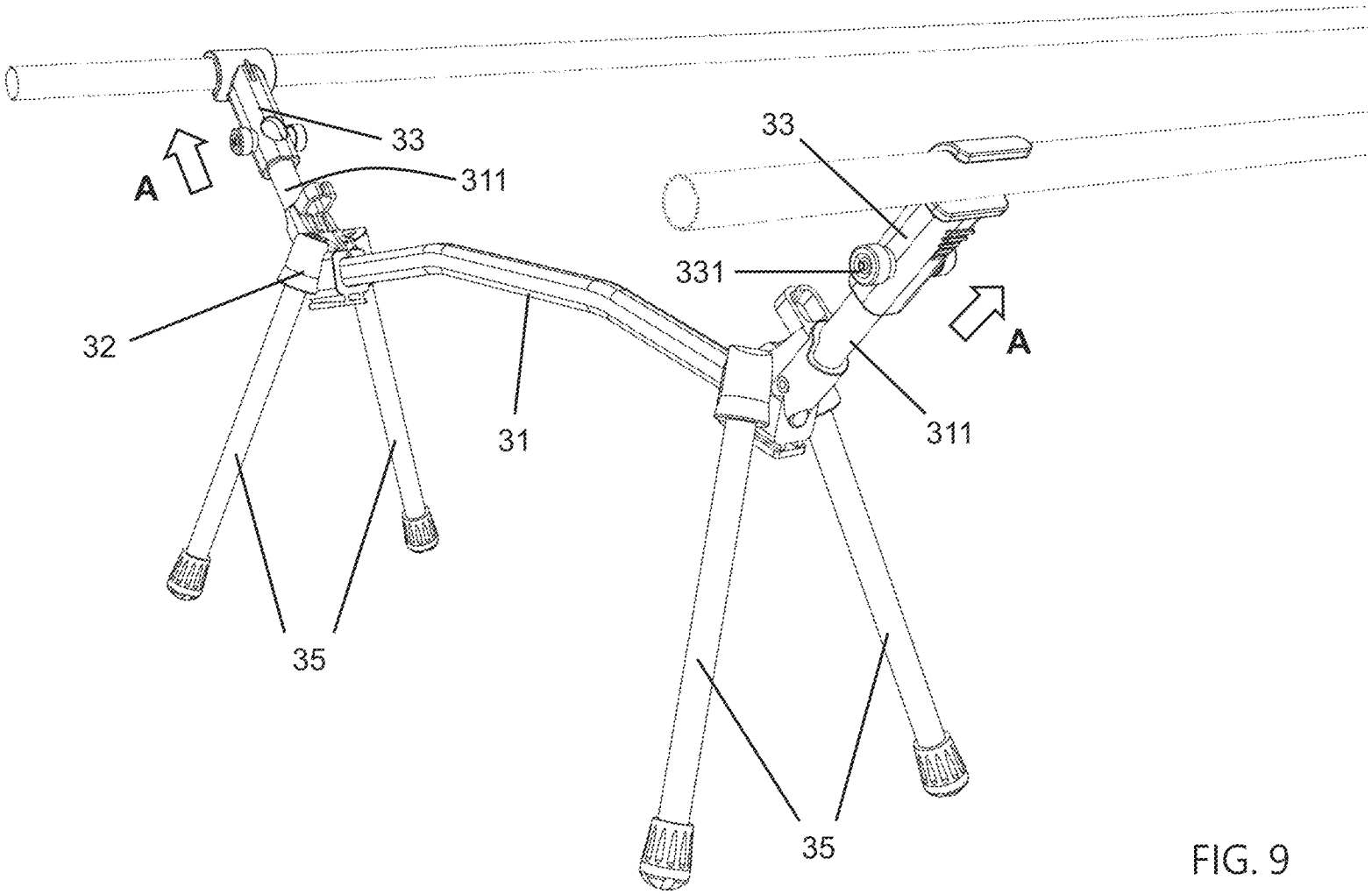
FIG. 9 is a perspective view of a supporting structure with an operating direction according to an embodiment of the present invention.

As shown in FIGS. 7 and 9, the U-shaped branch 31 of the supporting structure 200 is the middle structure of the supporting structure 200 and is used as a support for load bearing. The two sides of the U are two side arms 311 on both sides of the supporting structure 200.

As shown in FIGS. 7 and 9, two leg brackets 32 in the supporting structure 200 are connected to the two U-shaped bends of the U-shaped branch 31. Each leg bracket 32 has at least two legs 35. The leg bracket 32 of this embodiment has two legs 35, which is a better choice for both stability during use and convenience when stored.

Figure 8:
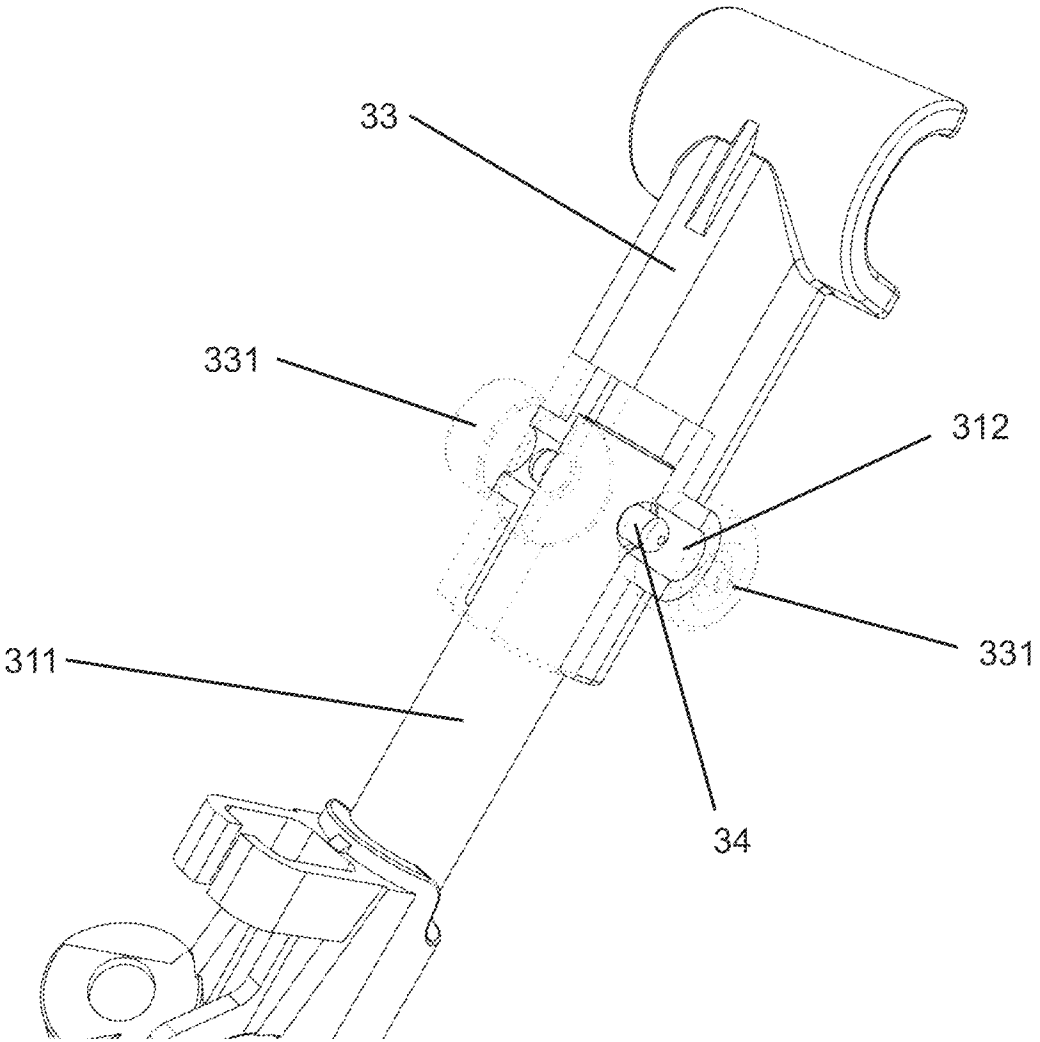
FIG. 8 is a perspective view of a C-shaped opening sliding sleeve, protruding tenon, side arm, and retaining groove of a supporting structure according to an embodiment of the present invention.

As shown in FIG. 7 and FIG. 8, two C-shaped opening sliding sleeves 33 of the support structure 200 are connected to the end points of the support arms 311 on either side of the U-shaped branch 31. The C-shaped opening sliding sleeves 33 are lateral C-shaped opening sliding sleeves 33. A lateral C-shaped opening sliding sleeve 33 as described herein refers to a sleeve in which the C-shaped opening at the end of the sleeve is perpendicular to the sleeve body or is arranged at an angle relative to the sleeve body.

As shown in FIG. 8, any C-shaped opening sliding sleeve 33 can be slid on the side arm 311 of the U-shaped branch 31, or can be fixed to the side arm 311 of the U-shaped branch 31 by the protruding tenon 34 set on the C-shaped opening sliding sleeve 33.

As shown in FIG. 9, when the embodiment is used in applications, the C-shaped opening sliding sleeve 33 is attached to the side arm 311 and slides in the direction of the arrow of the sliding direction A in FIG. 9 away from the leg bracket 32, and is fixed to the side arm 311 of the U-shaped branch 31 by the provided protruding tenon 34, thereby generating a center length difference between the C-shaped opening sliding sleeves 33 on both sides of the supporting structure 200. The generated center length difference generates an outward tightening stress, which firmly tightens the objects clamped by the C-shaped opening sliding sleeves 33 on both sides during the embodiment. In addition, the C-shaped opening sliding sleeve 33 is fixed to the side arm 311 of the U-shaped branch 31 by the protruding tenon 34 without sliding, and the supporting structure 200 will not move or loosen, ensuring safe use.

As shown in FIG. 8, the supporting structure 200 includes two side arms 311 on either side of the U-shaped branch 31, each of which is provided with a retaining groove 312. The retaining groove 312 corresponds to the protruding tenon 34 of the C-shaped opening sliding sleeve 33.

Furthermore, the C-shaped opening sliding sleeve 33 is provided with a release button 331 corresponding to the position of the retaining groove 312. During applications of the embodiment, after the C-shaped opening sliding sleeve 33 slides to the relative position, the protruding tenon 34 enters and locks into the retaining groove 312, preventing the C-shaped opening sliding sleeve 33 on both sides of the taut supporting structure 200 from moving or rotating. After use, to release the tight clamping of the C-shaped opening sliding sleeve 33 on the object, simply press the release button 331 on the C-shaped opening sliding sleeve 33 corresponding to the retaining groove 312 of the sidet arm 311 to push the protruding tenon 34 out of the retaining groove 312. Then, slide the C-shaped opening sliding sleeve 33 in the direction opposite to the direction of the arrow A shown in FIG. 9 to release the taut clamping force.

In summary, as shown in the various embodiments and drawings of FIGS. 1 to 9, by implementing the special structural features of the convenient bed structure 100 with improved support assemblies 30 and the supporting structure 200 of the present invention, not only can the convenient bed structure 100 and the supporting structure 200 be simply set up, operated or stored, and have easy operation and assembly; they provide applications with a highly safe combination structure; they will not become loose and cause tipping, avoiding the danger of use and other special effects, and can be immediately applicable to various different application needs such as homes, hospitals or in the wild, or other occasions as needed, to achieve multi-functional applications and effectively increase suitable application occasions, and the acceptance and willing of usage can be effectively and significantly improved.

The embodiments described above are intended only to demonstrate the technical concept and features of the present invention to enable a person skilled in the art to understand and implement the contents disclosed herein. It is understood that the disclosed embodiments are not to limit the scope of the present invention. Therefore, all equivalent changes or modifications based on the concept of the present invention should be encompassed by the appended claims.

What is claimed is:

1. A convenient bed structure with improved support assemblies, comprising:

a bed fabric, which is long and has two opposite long sides, each of which is formed with a plurality of annular wrapping structures;

two straight bars, one of the straight bars passes through each of the annular wrapping structures of one of the long sides to support the bed fabric and a load carried; and plural support assemblies, used to support the convenient bed structure and all loads thereon, said support assemblies are arranged in the same direction between the two straight bars, each support assembly is respectively buckled and fastened to the two straight bars with C-shaped opening sliding sleeves at opposite ends;

wherein any of the support assemblies includes a U-shaped branch, a pair of leg brackets connected to the two U-shaped bends of the U-shaped branch, and two C-shaped opening sliding sleeves connected to the end points of the side arms on both sides of the U-shaped branch, wherein any one of the C-shaped opening sliding sleeves can be slid on the side arms of the U-shaped branch or can be fixed to the side arms of the U-shaped branch by a protruding tenon provided on the C-shaped opening sliding sleeve, wherein the side arms on both sides of the U-shaped branch are respectively provided with a retaining groove corresponding to the protruding tenon, and the C-shaped opening sliding sleeve is provided with a release button corresponding to the position of the retaining groove.

2. The convenient bed structure with improved support assemblies of claim 1, wherein any of the C-shaped opening sliding sleeves is a lateral C-shaped opening sliding sleeve.

3. The convenient bed structure with improved support assemblies of claim 1, wherein when any of the C-shaped opening sliding sleeves is buckled and tightly clamped to a straight bar, the opening is outward.

4. The convenient bed structure with improved support assemblies in claim 1, wherein the C-shaped opening sliding sleeves at opposite ends of any support assembly are respectively engaged with the two straight bars, and are then slid toward the straight bars and fixed to the U-shaped branch by the protruding tenon, and a center length difference is generated between the C-shaped opening sliding sleeves on opposite sides.

5. The convenient bed structure with improved support assemblies in claim 1, wherein any of the leg brackets has at least two legs.

6. The convenient bed structure with improved support assemblies in claim 2, wherein the C-shaped opening sliding sleeves at opposite ends of any support assembly are respectively engaged with the two straight bars, and are then slid toward the straight bars and fixed to the U-shaped branch by the protruding tenon, and a center length difference is generated between the C-shaped opening sliding sleeves on opposite sides.

7. The convenient bed structure with improved support assemblies in claim 2, wherein any of the leg brackets has at least two legs.

8. The convenient bed structure with improved support assemblies in claim 3, wherein the C-shaped opening sliding sleeves at opposite ends of any support assembly are respectively engaged with the two straight bars, and are then slid toward the straight bars and fixed to the U-shaped branch by the protruding tenon, and a center length difference is generated between the C-shaped opening sliding sleeves on opposite sides.

9. The convenient bed structure with improved support assemblies in claim 3, wherein any of the leg brackets has at least two legs.

10. A supporting structure, comprising:

a U-shaped branch;

a pair of leg brackets, respectively connected to the two U-shaped bends of the U-shaped branch; and two C-shaped opening sliding sleeves connected to the end points of the side arms on both sides of the U-shaped branch, wherein each C-shaped opening sliding sleeve is a lateral C-shaped opening sliding sleeve;

wherein any one of the C-shaped opening sliding sleeves can be slid on the side arms of the U-shaped branch or can be fixed to the side arms of the U-shaped branch by a protruding tenon provided on the C-shaped opening sliding sleeve, wherein the side arms on both sides of the U-shaped branch are respectively provided with a retaining groove corresponding to the protruding tenon, and the C-shaped opening sliding sleeve is provided with a release button corresponding to the position of the retaining groove.

11. The supporting structure of claim 10, wherein the C-shaped opening sliding sleeves are attached to the side arms and slide away from the leg brackets, and are fixed to the side arms by the protruding tenon, generating a center length difference between the C-shaped opening sliding sleeves on opposite sides of the supporting structure.

12. The supporting structure of claim 10, wherein any of the leg brackets has at least two legs.

* * * * *